United States Patent [19]

Hokenson

[11] Patent Number: 4,655,163

[45] Date of Patent: Apr. 7, 1987

[54] APPARATUS FOR PRESSING CORRUGATED WEB AGAINST GLUE APPLICATOR ROLL

[76] Inventor: Earl G. Hokenson, 620 N. Douglas St., Appleton, Wis. 54914

[21] Appl. No.: 807,103

[22] Filed: Dec. 9, 1985

Related U.S. Application Data

[63] Continuation of Ser. No. 636,125, Jul. 30, 1984, abandoned.

[51] Int. Cl.[4] ..... B05C 1/08; B05C 13/00

[52] U.S. Cl. ..... 118/62; 118/249

[58] Field of Search ..... 118/62, 249, 248; 15/307

[56] References Cited

U.S. PATENT DOCUMENTS

| | | | |
|---|---|---|---|
| 1,741,382 | 12/1929 | Stokes | 118/62 X |
| 3,066,517 | 12/1962 | Deyber | 15/307 X |
| 3,303,814 | 2/1967 | Nitchie | 118/249 |
| 3,589,331 | 6/1971 | Westervelt et al. | 118/62 |
| 3,753,418 | 8/1973 | Roncan | 118/63 |
| 3,929,097 | 12/1975 | Kanda et al. | 118/62 |
| 4,096,826 | 6/1978 | Stange | 118/62 X |
| 4,103,644 | 8/1978 | Michels | 118/62 |

*Primary Examiner*—John P. McIntosh

*Attorney, Agent, or Firm*—Nicholas A. Kees

[57] ABSTRACT

An apparatus for ensuring that the flute tips of a corrugated web receive a certain amount of glue before having the second liner thereto. The apparatus includes a hollow air bar, formed by an outside wall and two end caps, which replaces the conventional rider roll in the corrugating machine. A source of air, such as a pump, is connected to the air bar for supplying air to it. Air outlets on the side of the air bar facing the web allows the air to impact against the web and hold the web against the conventional applicator roll so that glue is applied properly to the flute tips of the web. Means are provided for directing the air escaping from the outlets more directly against the web, and for adjusting the effective length of the air bar to approximately match the width of the web being processed. This latter function is accomplished by placing air plugs within the air bar and moving the plugs to the proper position in the air bar such that the outlets outside the width of the web are cut off from the source of air, while those within the width of the web are supplied with air.

10 Claims, 9 Drawing Figures

APPARATUS FOR PRESSING CORRUGATED WEB AGAINST GLUE APPLICATOR ROLL

This application is a continuation of application Ser. No. 636,125, filed July 30, 1984, now abandoned.

BACKGROUND OF THE INVENTION

This invention relates to machines for manufacturing corrugated board, and in particular to an improvement wherein an air bar, having a length that can be varied to match the width of the web to which the glue is being applied, is employed to maintain proper pressure holding the web against the glue applicator roll.

Conventionally, corrugating machines begin with a liner, that is, a single sheet of paper. To this liner the machine applies a fluted medium, by use of glue, to form a web. Then a second liner is glued to the flute tips of the web opposite the first liner to complete the process. In the process of gluing this second liner to the web, conventional corrugating machines apply glue to the flute tips by use of an applicator roll and a rider roll. The applicator roll turns at or just below the speed of the web, while its lower portion is immersed in a tank of glue. As it turns, of course, some of the glue adheres to the roll surface as it leaves the tank. When the surface of the applicator roll then touches the flute tips of the web, some of the glue is applied to the flute tips. In order to ensure that each flute tip does touch the applicator roll so as to have glue applied to it, pressure must be applied to the back of the first liner. In a conventional corrugating machine, this pressure behind the first liner is applied by a rider roll made of metal or other hard material. Such a rider roll must be very carefully controlled, however, since the flute tips can be crushed if the gap between the rider roll and the applicator roll becomes too small, or the flute tips could lift off the applicator roll and receive no glue if the gap becomes too large.

Even if the rider roll is sufficiently controlled so that crushing and liftoff are avoided, when the pressure exerted by the rider roll is only slightly too great, too much glue can be applied to the flute tip. When too much glue is thus applied, the result can be "washboarding." Washboarding is a physical fault in corrugated board wherein the liner, instead of forming a flat surface, partly follows the contours of the fluted medium to produce generally parallel alternate ridges and valleys. It is clear that printing on such an uneven surface is difficult. The unevenness makes it necessary for the printer to increase the depth of the die impression, which can again crush the board to some extent. In order to avoid this effect, control mechanisms have been designed, often at great expense, to exactly control the position and pressure of the rider roll.

This invention relates to solutions to the problems described above.

SUMMARY OF THE INVENTION

The invention includes a hollow air bar about the same length as the applicator roll of the particular corrugating machine into which the device is being installed. This air bar replaces the rider roll in the conventional corrugating machine on the rider roll arm. The rider roll arm pivots at one end and is connected to a control cylinder at the other end with the air bar connected between, so that the air bar can be positioned properly over the applicator roll, and lifted away from the applicator roll to facilitate threading. The air bar is supplied with air from a compressor or blower, and has at least one row of outlets for letting the air escape against the web as the web passes over the conventional applicator roll of the corrugating machine. In addition, the air bar has means, preferably flexible, for directing the air against the web. It also includes means for closing off the outlets which are beyond the width of the web currently running in the machine, changing the effective length of the air bar, so that only those outlets within the width of the web have air escaping from them.

It is therefore an object of this invention to provide an improvement over the conventional "rider roll" apparatus for holding the flute tips of the web against the applicator roll.

Another object of the invention is to provide an air bar which employs air to force the flute tips against the glue applicator roll of a corrugating machine.

A further object of the invention is to provide such an air bar having means for directing the air more directly against the web as it passes under the air bar.

Still another object of the invention is to provide such an air bar which in addition has means for closing off some of the outlets for air so that the open outlets are over the web only.

Other objects and advantages of the invention will become apparent hereinafter.

DESCRIPTION OF THE PREFERRED EMBODIMENTS

Figure 1:
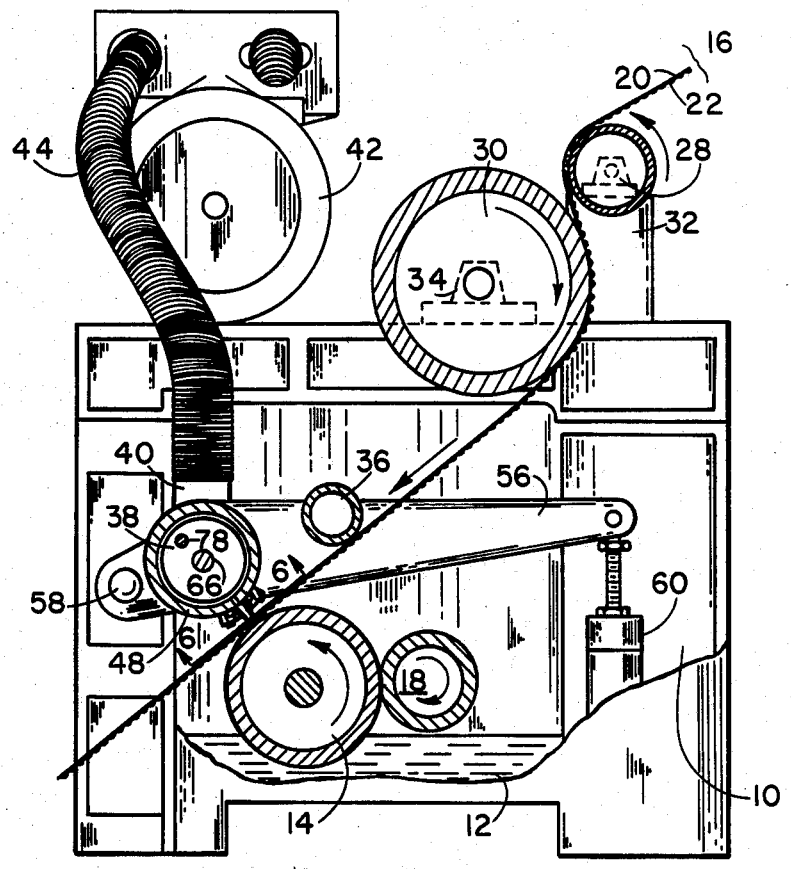
FIG. 1 is a side view, partially in section, of a corrugating machine employing an embodiment of the invention.

Referring now to FIG. 1, it can be seen that a largely conventional frame 10 for a corrugating machine can be employed. Also as is normal in a conventional corrugating machine, a starch tank 12 holds a certain amount of "starch," as the liquid glue is called in the industry. A conventional applicator roll 14 turns in starch tank 12, where some of the glue adheres to the roll as that part of the roll turns out of the tank. Before a part of the roll gets to the web 16 to apply glue to it, excess glue is removed by metering roll 18. The web 16 enters at the upper right as shown in FIG. 1, having already had the first liner 20 glued to the fluted medium 22, as better shown in FIG. 2.

Figure 3:
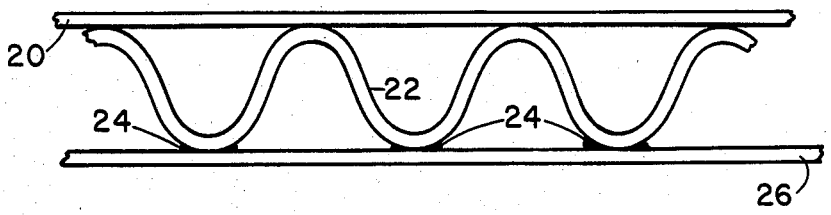
FIG. 3 is an enlarged sectional view of properly constructed corrugated board.
Figure 4:
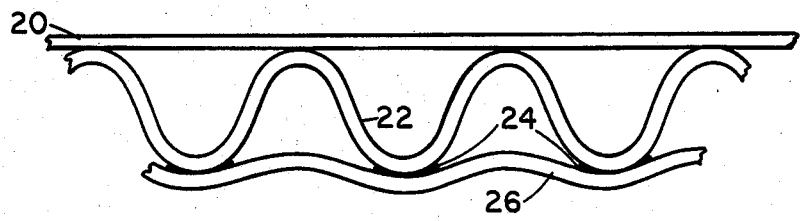
FIGS. 4 and 5 are enlarged sectional views of improperly constructed corrugated board.
Figure 5:
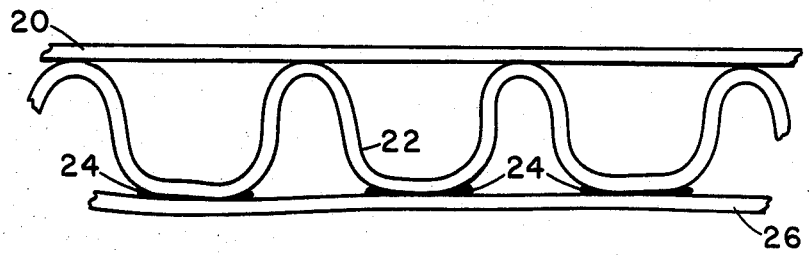

It must be kept in mind that the operation to which this invention is intended to be applied is merely the application of glue 24 to the tips of the fluted medium 22 prior to application of a second liner 26 as shown in FIG. 3 in finished form. FIG. 4 shows an example of corrugated board where too much glue 24 was applied to the flute tips, causing the effect known as "washboarding," wherein the second liner 26 follows to an extent the fluting of the medium 24. This effect results in an uneven surface which is difficult to print on, which in turn reduces the value of the finished product. In FIG. 5 is shown an example of board wherein the medium has been crushed, as evidenced by the loss of the sine wave pattern of the medium 22. This crushing results not only in an uneven printing surface but also in loss of strength of the board, again reducing the value of the product.

Referring again to FIG. 1, then, the web 16 enters this part of the corrugating machine by passing over tensioning rollers 28 and 30, one or the other of which may include a conventional preheating feature to preheat the web so that the glue which is applied as described below adheres better. These tensioning rollers are conventionally journaled to supports 32 and 34 which are in turn secured to frame 10. Web 16 next passes under a conventional crown break roll 36, the purpose of which is to prevent or eliminate longitudinal wrinkles in web 16. Finally, web 16 passes between applicator roll 14 and air bar 38 for the application of glue to the flute tips. As explained above, applicator roll 14 has a certain amount of liquid glue adhering to its surface. As web 16 passes over roll 14, some of this glue is transferred to the flute tips of the medium 22. The amount of glue transferred is dependent at least in part upon the pressure holding web 16 against roll 14.

Air bar 38 is provided for the purpose of supplying pressure for holding web 16 against roll 14. To this end, the inlet 40 of air bar 38 is supplied with air or any other suitable fluid by communicating with pump or blower 42 via any suitable means, such as tubing 44. The pressure under which the air is supplied should be low to avoid damage to the flutes, but adequate to hold web 16 against roll 14. For example, the pressure could be in the area of half a pound per square inch above atmospheric, and certainly no more than a few pounds per square inch above atmospheric. The purpose of the air pressure is not to hold the web tightly against roll 14 but rather to cause the flute tips to lightly touch the roll, each tip picking up just a bit of glue so that the second liner, to be applied later, adheres without washboarding. This is best shown in FIG. 2, which shows a portion of FIG. 1 enlarged to show detail.

Figure 6:
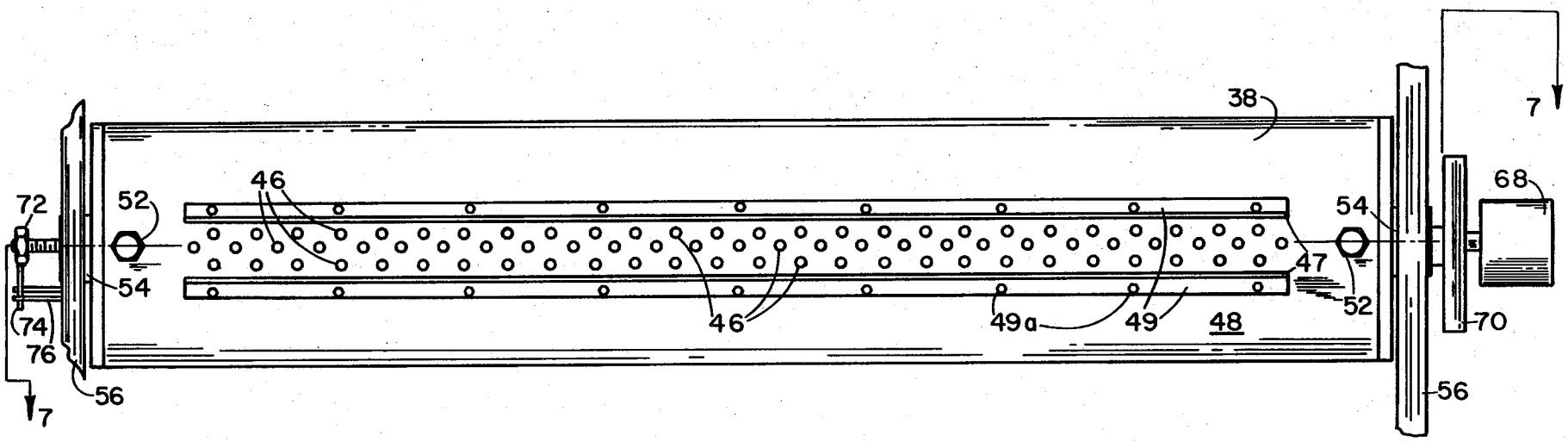
FIG. 6 is a sectional view of FIG. 1 taken along line 6—6.
Figure 7:
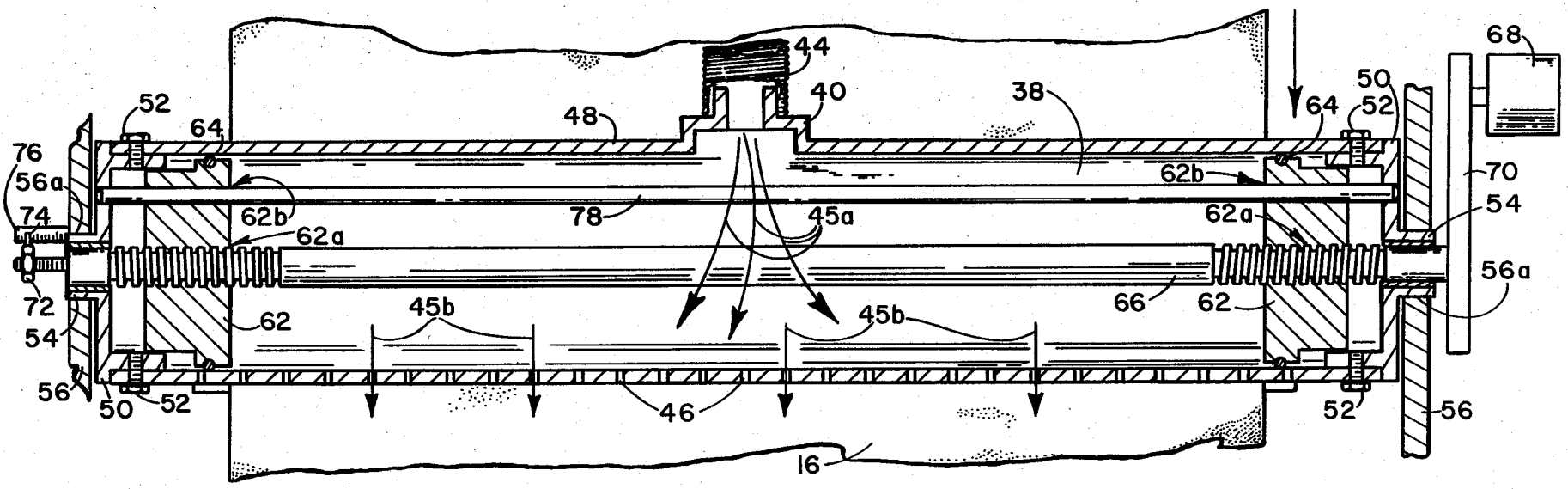
FIG. 7 is a sectional view of FIG. 6 taken along line 7—7.

Referring now to FIGS. 6 and 7, the air bar 38 is there shown in more detail. FIG. 6 shows a view of the air bar 38 as seen from the bottom, that is, as seen by the web 16 passing between it and the applicator roll 14. FIG. 7 shows a section through air bar 38 along line 7—7 of FIG. 6. As can be seen in these drawing figures, the air bar 38 is provided with a number of outlets 46 along its length, through which the air or other fluid supplied by pump 42 (FIG. 1), as shown by arrows 45*a*, is allowed to escape as shown by arrows 45*b* against web 16. While any suitable arrangement of outlets may be employed, it is preferred that there be three rows of outlets, approximately centered with respect to the length of air bar 38, and running substantially the length of the air bar. The length of the rows should be approximately the same as the largest standard width of web 16, that is, 88 inches for an 87 inch machine, 97 inches for a 96 inch machine, etc. Ideally, the outlets 46 should have a diameter of about five sixteenths (5/16) of an inch, and the centers of outlets in the same row should be about an inch apart. Ideally the centers of the rows of outlets should be from ½ to ¾ of an inch apart, and the outlets should alternate, that is, each outlet in any particular row should be located midway between two outlets of a neighboring row, as shown in FIG. 6.

Figure 2:
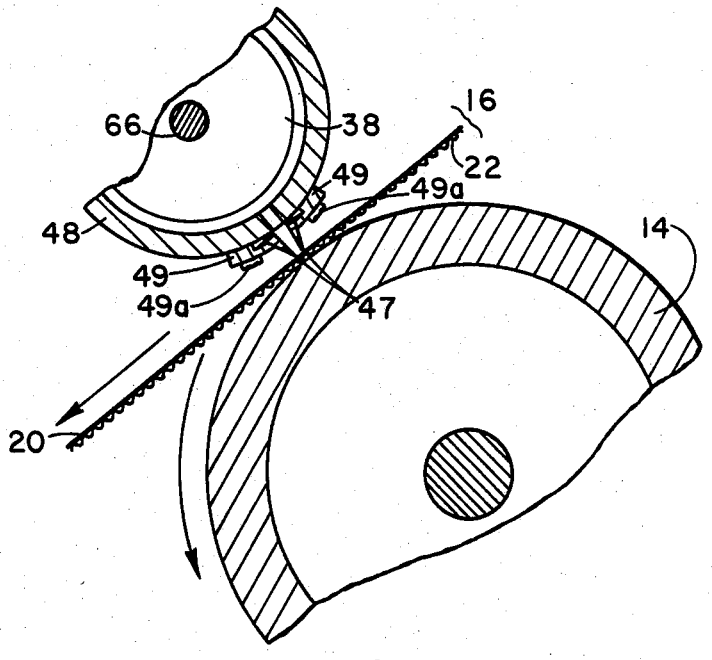
FIG. 2 is an enlarged view of a portion of FIG. 1.

In order to better direct the flow of air from outlets 46 onto web 16, means for directing the air flow is provided as shown in FIGS. 2 and 6. This air flow direction means preferably includes flexible gaskets 47 reaching to within one inch or less of web 16, replaceably attached to outer wall 48 of air bar 38, preferably by means of metal straps 49 bolted 49*a* to wall 48.

As shown partially in section in FIG. 7, the outlets 46 described above are made in outer wall 48 of air bar 38. The ends of wall 48 are closed by end caps 50, also shown in isometric in FIG. 8, which conform to the cross-sectional shape of wall 48. In the embodiment shown in FIGS. 1 and 8, for example, this shape is circular, although any suitable shape could be employed. These end caps 50 are removably attached to wall 48, such as by screws or bolts 52. For reasons which will be explained presently, the connection between end caps 50 and the wall 48 need not be airtight or sealed against leakage. The purpose of the caps is merely to provide rigid support for the rest of air bar 38. To this end, each of the end caps 50 is provided with a collar 54, preferably formed integrally with the respective end cap, on the side of the end cap opposite where wall 48 is attached to the end cap, that is, outside the chamber formed by wall 48 and end caps 50. These collars 54 are then inserted in corresponding openings 56*a* in arms 56. Arms 56 are shown in section in FIGS. 6 and 7. One of arms 56, however, is shown in side view in FIG. 1. It can there be seen that arm 56 is journaled on a pin 58 secured to frame 10. Each of the two arms 56 functions the same way except that they are on opposite ends of air bar 38. As shown in FIG. 1, crown break roll 36 is journaled in arms 56. The end of each arm 56 opposite pin 58 is pivotably connected to one end of a control cylinder 60, the opposite end of cylinder 60 being pivotably attached to frame 10, although this latter attachment is not shown. Together, arm 56 and cylinder 60 form a means for controlling the position of air bar 38 with respect to applicator roll 14, that is, a means for moving air bar 38 towards and away from applicator roll 14 and, of course, web 16. Hence for instance when the web 16 is being threaded into the machine, cylinder 60 is extended causing arm 56 to pivot upward, which in turn moves air bar 38 away from applicator roll 14 to facilitate the threading operation. Finer adjustments can also be made so that, considering differences in caliper, that is, thickness of web 16, the air bar 38 can be maintained in a most advantageous position to ensure proper pressure of the web 16 against the applicator roll 14.

Referring again to FIG. 7, the internal functioning of air bar 38 can there be observed. Between end caps 50 are air plugs 62, also shown in isometric in FIG. 9. The shape of the outer surface of each air plug 62 conforms closely to the cross-sectional shape of the inner surface of wall 48. For instance in FIGS. 1 and 9 this shape is shown to be circular, although any suitable shape could be employed. Any gap between each air plug 62 and the wall 48 is sealed against air leakage by any suitable means such as a flexible O-ring 64 set in a groove of air plug 62. It is because of this seal that the connection between the wall 48 and the end caps 50 need not be airtight or sealed against leakage. Each air plug 62 also has at least one hole 62*a* horizontally through it, aligned with the collar 54 of each end cap 50 and with the hole of the opposite air plug. This hole is threaded in the same manner and size in each air plug 62, such that when the two air plugs 62 are assembled in air bar 38 and face each other as shown in FIG. 7, the direction of the threads in one is the opposite of the threads in the other. A single rod 66, threaded on the ends near the air plugs with threads that match the respective plugs, runs through the plugs and is journaled through collars 54 to the outside of air bar 38. To one end of rod 66 is connected means for turning rod 66 from outside of air bar 38. In the preferred embodiment, this means could be a motor 68 and gear reducer 70, shown schematically in FIGS. 6 and 7. Thus when motor 68 turns rod 66 via gear reducer 70, plugs 62 are forced to move. If rod 66 turns in one direction, plugs 62 move towards each other. If rod 66 turns in the opposite direction, plugs 62 move away from each other. It can be seen in FIG. 7, then, that as plugs 62 move, they cover or uncover some of the outlets 46, thereby limiting the width of web to which pressure is applied by the air escaping from the outlets. This function effectively limits the length of the air bar to match closely the width of the web 16 currently being processed. This is significant because pressure should be applied uniformly throughout the width of web 16, but open outlets beyond the edge of the web would waste air pressure and reduce the pressure exerted on the web by air escaping from outlets between the edges of the web.

Figure 9:
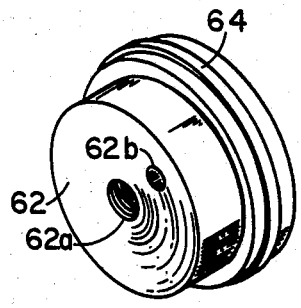
FIG. 9 is an isometric view of an air plug employed in one embodiment of the invention.
Figure 8:
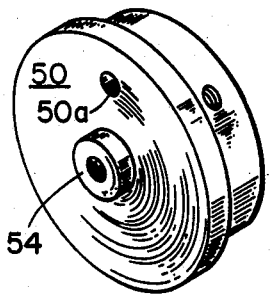
FIG. 8 is an isometric view of an end cap employed in one embodiment of the invention.

To make the air bar 38 work properly where its cross-section is round, as shown in FIGS. 1 and 9, means must be included to prevent plugs 62 from turning along with rod 66. As shown in FIGS. 7, 8 and 9, a second hole **62*b* is formed in each of the two plugs 62 and a hole 50*a* in each of the two end caps 50, making sure that all four holes are aligned, and each removed a distance from the holes therein made for rod 66. A second rod 78, just long enough to reach through both end caps 50, is inserted through these holes parallel to rod 66. Rod 78 is smooth so that plugs 62 can slide along it easily while it prevents them from turning because of the fact that it is also inserted in holes 50*a* in end caps 50**.

To the end of rod 66 opposite motor 68 and reducer 70 is connected an indicating means for indicating the width of web 16 for which the air bar 38 is set. In the embodiment shown in FIG. 7, this indicating means includes a portion of rod 66 which extends through collar 54 and is threaded. A nut 72 is threaded thereon. A needle or other indicating pointer 74 is secured to the nut 72. Nut 72 is prevented from turning with respect to air bar 38 by a forked scale 76. Scale 76 is secured to air bar 38 or arm 56 such that the two prongs of scale 76 are approximately parallel to rod 66. Pointer 74 is placed between the two prongs, and is attached to nut 72 so as to be roughly perpendicular to rod 66. Scale 76 is marked such that pointer 74 indicates the width between the air plugs 62, that is, the width of web at which air bar 38 is set. In the preferred embodiment, the threads on the portion of rod 66 outside air bar 38 are finer than those in air plug 62, so that scale 76 is shorter than the larger threaded portion of rod 66, for convenience reasons, and still is marked so as to accurately indicate the width at which air bar 38 is set.

While the apparatus hereinbefore described is effectively adapted to fulfill the aforesaid objects, it is to be understood that the invention is not intended to be confined to the particular preferred embodiments of apparatus for pressing a corrugated web against a glue applicator roll. Rather, the invention is to be taken as including various equivalents without departing from the scope of the appended claims.

What is claimed is:

1. An apparatus for applying glue to the flute tips of the corrugated medium of a web, comprising:

frame means for providing support to the various other parts, having a tank containing glue which tank has an open top;

an applicator roll, journaled in said frame means and partially submerged in the glue in said tank, which roll turns at approximately the same speed as the web moves through the machine;

an air bar, communicating with a source of air, disposed behind the web with respect to said applicator roll, and having outlets for allowing the air to escape from said air bar and impact on the web; and flexible gasket means attached to the surface of said air bar for directing the escaping air more directly against the web;

such that the flute tips are forced against said applicator roll by the escaping air and a small amount of glue is applied to the flute tips.

2. An apparatus as recited in claim 1 further comprising arm means for moving said bar towards and away from the web and said applicator roll by means of control cylinders to facilitate threading of the web and ensure proper pressure of the web against the applicator roll.

3. An apparatus as recited in claim 2 further comprising a crown break roll journaled to said arm means upstream from said air bar and applicator roll for eliminating longitudinal wrinkles in the web.

4. An apparatus as recited in claim 2 wherein said air bar is secured non-rotatably to said arm means and formed by an outer wall having a certain cross-sectional shape and two end caps, one on each end, which conform to the cross-sectional shape of the wall, said air outlets being openings arranged generally longitudinally along said bar in three or less rows, the centers of said outlets within the same row being about one inch apart while the centers of adjacent rows of outlets are ½ to ¾ inch apart, further comprising means for adjusting the effective width of said air bar such that it is not greater than the width of the web being processed;

said adjusting means including means for closing the outlets of said air bar which are beyond the edges of the web;

which closing means includes air plugs disposed within said wall of said air bar between said end caps, the outer surfaces of which plugs conform closely to the cross-sectional shape of said wall, any gap between said plugs and said wall being sealed against air leakage, and means for moving said air plugs towards and away from each other such that the air only reaches those outlets located between those plugs and no other outlets.

5. An apparatus as recited in claim 1 wherein said outlets are arranged generally longitudinally along said bar in three or less rows, the center of said outlets within the same row being about one inch apart while the centers of adjacent rows of outlets are ½ to ¾ inch apart.

6. In combination with a web having a corrugated medium and a first liner glued to one side of said medium, said medium having a plurality of flute tips projecting away from said first liner, an apparatus for applying glue to said flute tips comprising:

frame means having a tank containing glue, which tank has an open top;

an applicator roll, journaled in said frame means and partially submerged in the glue in said tank and having a surface adapted to apply glue to said flute tips, said roll rotating such that said surface moves at approximately the same speed as said web moves through said apparatus;

an air bar, communicating with a source of air, disposed behind the web with respect to said applicator roll, and having outlets for allowing air to escape from said air bar and impact on the web, forcing the flute tips of the web against said applicator roll, such that glue is applied to the flute tips;

means for directing the air escaping from the outlets of said air bar against the web, comprising flexible gaskets attached to the surface of said air bar;

means for moving said air bar towards and away from the web and said applicator roll, comprising at least one arm which is pivotably mounted to said frame means and actuated by at least one control cylinder;

wherein said air bar is secured non-rotatably to said at least one arm and formed by an outer wall having a certain cross-sectional shape and two end caps, one in each end, which conform to the cross-sectional shape of said outer wall.

7. An apparatus as recited in claim 6 further comprising:

means for adjusting the effective width of said air bar so that it is not greater than the width of the web being processed, and means for indicating the effective width at which said bar is set, said adjusting means including means for closing the outlets of said air bar which are beyond the edges of the web;

said closing means including air plugs disposed within said wall of said air bar between said end caps, the outer surfaces of which plugs conform closely to the cross-sectional shape of said wall, any gap between said plugs and said wall being sealed against air leakage, and means for moving said air plugs towards and away from each other such that the air only reaches those outlets located between those plugs and no other outlets.

8. An apparatus as recited in claim 7 wherein said means for moving said air plugs comprises a rod journaled in said end caps, which rod is threaded in opposite directions through said plugs, and means for turning said rod from outside of said air bar such that the outlets which air is allowed to reach can be changed from outside of said air bar.

9. An apparatus as recited in claim 8 wherein the cross-sectional shape of the air bar is round, and further comprising means for preventing said air plugs from turning when said threaded rod turns, including a second rod offset from said threaded rod, slideably engaging said air plugs and secured to said end caps.

10. An apparatus as recited in claim 8 wherein said indicating means includes threading on said rod outside of said end caps, a nut threaded onto said outside threading, an indicating pointer attached to said nut, said nut being prevented from turning by a forked scale secured to said arm surrounding said pointer, said scale having markings thereon so that as said rod turns to move said plugs, said nut also moves along said scale so as to indicate the effective width at which the air bar is set.

* * * * *